United States Patent [19]

Cunningham

[11] 4,080,946

[45] Mar. 28, 1978

[54] INTERNAL COMBUSTION ENGINE SHUT-DOWN CONTROL VALVE

[75] Inventor: Paul B. Cunningham, Pittsburgh, Pa.

[73] Assignee: Lenmar Industries, Inc., Pittsburgh, Pa.

[21] Appl. No.: 752,252

[22] Filed: Dec. 20, 1976

[51] Int. Cl.[2] ..... F02B 77/00

[52] U.S. Cl. ..... 123/198 DB; 123/198 D; 123/196 S; 60/601; 251/63.6

[58] Field of Search .... 123/198 D, 198 DC, 198 DB, 123/41.15, 196 S; 60/601, 603; 251/62, 63, 63.5, 63.6

[56] References Cited

U.S. PATENT DOCUMENTS

| | | | |
|---|---|---|---|
| 2,247,309 | 6/1941 | Robison | 123/196 S |
| 3,148,671 | 9/1964 | Bottorff et al. | 123/198 DB |
| 3,153,403 | 10/1964 | Dobbs | 123/198 DB X |
| 3,202,143 | 8/1965 | Goodwin | 123/41.15 |
| 3,523,521 | 8/1970 | Goodwin | 123/198 DB |
| 3,533,390 | 10/1970 | Goodwin | 123/198 DB |
| 3,590,798 | 7/1971 | Goodwin | 123/198 D |
| 3,853,110 | 12/1974 | Van der Merue | 123/198 D X |
| 3,877,455 | 4/1975 | Goodwin | 123/198 DB X |
| 3,977,384 | 8/1976 | Jahn | 123/198 DB |
| 4,044,560 | 8/1977 | Dorsch et al. | 60/603 |

*Primary Examiner*—Charles J. Myhre
*Assistant Examiner*—Ira S. Lazarus
*Attorney, Agent, or Firm*—Bauer, Amer & King

[57] ABSTRACT

A valve in the fuel line of an internal combustion engine of the type which is normally biased to its closed position, causing engine shut-down, but prevented by an opposing oil pressure from doing so; the valve, in effect, therefore being one which promotes engine shut-down in the event of failure in the engine oil pressure. As an improvement to this class of valves, of which the within valve is a significant contribution, the valve has an engine shut-down function related not merely to the required oil pressure at engine start-up, but also to required oil pressures at full power speed as well as intermediate power speeds throughout its contemplated range of operation.

5 Claims, 2 Drawing Figures

INTERNAL COMBUSTION ENGINE SHUT-DOWN CONTROL VALVE

Figure 1:
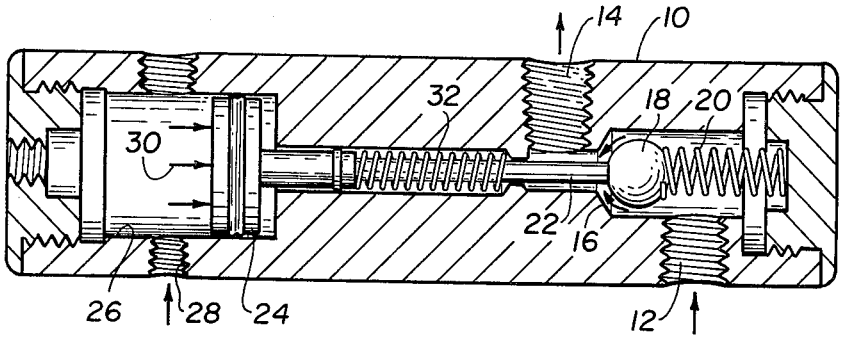
FIG. 1 PRIOR ART

The present invention relates generally to engine shut-down control valves, and more particularly to an improved shut-down valve that operates over a range of supervised oil pressures, and thus over a corresponding range of engine power speeds.

A typical engine shut-down control valve, as exemplified by the valve of U.S. Pat. No. 3,202,143, will protect the engine against damage by causing its shut-down in the event that the engine oil pressure falls below a selected minimum level. At start-up, when the engine speed is only a nominal 555 rpm, oil at approximately 14 psi nominal will achieve a proper lubricating function. At full power, however, when the engine is typically running at 1800 rpm, lubrication cannot be achieved with oil at less than 40 psi nominal. The referred to prior art engine shut-down control valve, being restricted as it is to a single, selected oil pressure at which to provide its shut-down function, thus cannot provide engine protection at both start-up and full power, since there are different oil pressure requirements at these two operating ranges. Thus, other operating parameters of the engine are usually monitored or supervised, along with the use of a typical prior art oil pressure-operated shut-down control valve in order to protect the engine throughout its entire operating range.

Broadly, it is an object of the present invention to provide as improved shut-down control valve overcoming the foregoing and other shortcomings of the prior art. Specifically, it is an object to utilize oil pressure as the criteria for engine shut-down in a fuel line valve, but also to effectively relate the oil pressure to the changing operating requirements of the engine. Thus, at start-up the required oil pressure must exceed a selected minimum, and at full power, it must exceed a higher pressure level, or else the within valve will cause its shut-down to prevent damage due to inadequate lubrication.

As already noted, an internal combustion engine shut-down control valve that is generally contemplated herein is of the type having fuel for powering the engine flowing through an internal valve opening that is normally spring-biased closed except as a piston in the valve is biased by the oil pressure of the engine through movement towards the internal valve opening for maintaining the same in an open condition. As an improvement to the above, a valve demonstrating objects and advantages of the present invention includes the selection of means for exerting a pressure within the engine, such as an exhaust driven fan and/or super charger, to serve as a variable pressure source indicative of the operating requirements of the engine. Conduit means is connected between the selected pressure exerting means and the movement path of the internal valve-opening piston so as to interpose the exerted pressure of the selected source in opposition to the valve-opening movement of the piston. As a result, any engine shut-down occasioned by the termination of fuel flowing through the internal valve opening is thus related to the exerted pressure of the selected pressure source, and thus of necessity also is related to the engine operating requirement.

Figure 2:
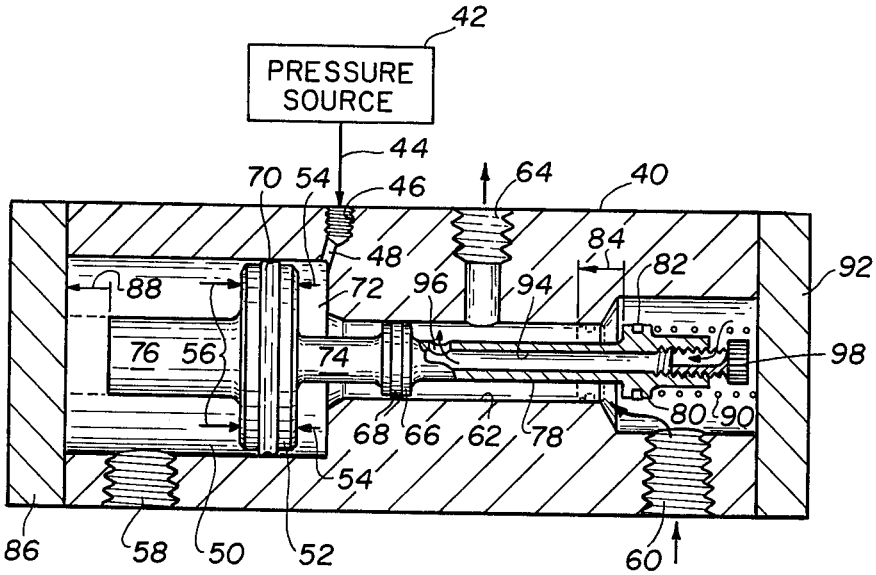

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a side elevational view, in longitudinal cross-section, of a typical prior art valve providing internal combustion engine shut-down control as a function of the oil pressure of the engine supervised by the valve; and FIG. 2 is an illustration of the within improved engine shut-down control valve, similarly in longitudinal cross-section, in which the improved structural features distinguishing the same over the FIG. 1 prior art valve are clearly illustrated.

The advantages of interposing a valve in the fuel line of an internal combustion engine to terminate the flow of fuel to the engine upon the failure of oil pressure is already well known, and is exemplified by the engine shut-down control valve of U.S. Pat. No. 3,202,143. The typical construction of such a valve is illustrated in FIG. 1 and generally designated 10 therein. Briefly, valve 10 is interposed in the fuel line of the internal combustion engine and, to this end, includes a fuel inlet 12 and a fuel outlet 14 through which the fuel powering the engine flows. Controlling this flow of fuel is a valve opening 16 having a cooperating ball valve 18 normally biased into a closed position by the valve spring 20. In the contemplated operation of the prior art valve 10, however, a probe or valve-unseating member 22 maintains the valve opening 16 in its open condition unless there is an emergency situation involving the oil pressure of the engine. More particularly, at the opposite end of the probe or member 22 there is a piston 25 which operates in a chamber 26 that is exposed to the oil pressure of the engine which enters this chamber through the inlet 28. To insure proper functioning of the internal combustion engine (not shown), the oil pressure should not be less than a specified minimum, usually 14 pounds per square inch nominal at start up of the engine. Thus, it is necessary that the exerted oil pressure, designated 30, which acts against the piston 24 be sufficient to overcome the resistance of the valve spring 20, as well as of a regulating spring 32, to unseat the ball valve 18 in order for the engine to receive its fuel supply through the passages 12,14. In practice, the force 30 exerted by the oil pressure is thus arranged to exceed the specified amount of approximately 14 nominal pounds per square inch to maintain the condition just described. In the event that this oil pressure is not maintained, ball 18 of course will assume a seated position in the valve opening 16, thereby cutting off the fuel supply and resulting in shut-down of the engine.

From the foregoing it should be readily appreciated that while the prior art valve 10 provides shut-down engine supervision for any selected specified amount of oil pressure, in the instance described being 14 pounds per square inch nominal, that the valve 10 is not responsive to changing operating conditions of the internal combustion engine. As a specific example, it is known that at start up, the oil pressure, as just mentioned should be at least approximately 14 pounds per square inch nominal. At this time the engine will be typically running at 550 rpm and therefore oil pressure at 14 pounds per square inch nominal is adequate for complete lubrication of the engine during this phase of operation. However, at full power, such as 1800 rpm, it is necessary to have oil pressure which is not less than 40 pounds per square inch nominal. Thus, with a prior art valve 10, and in the assumed condition that the engine is operating at the full power speed of 1800 rpm, it is conceivable that there could be a failure in the oil pressure to the extent of it falling below the required 40 pounds per square inch nominal, and yet the supervising prior art valve 10 will not provide any engine shut-down function if the oil pressure 30 exceeds 14 pounds per square inch nominal.

In contrast to the foregoing, the shut-down control valve 40 hereof, illustrated in FIG. 2, provides shut-down supervision over the internal combustion engine in accordance with its changing operating conditions. Specifically, and as will be explained in detail, it will require, as does the prior art valve 10, that the oil pressure at start-up be in excess of the selected minimum amount, such as 14 pounds per square inch nominal, and valve 40, additionally, will also require that during engine operation, such as at full power, that the oil pressure be in excess of the higher selected minimum, as is required at that time to maintain proper lubrication of the engine. This essentially is achieved in the valve 40 by connecting the same to a source of pressure 42 which is of a variable amount during the operation of the engine and which, at any point in time, is related to the changing requirements for oil lubrication of the engine during its operation. For example, pressure source 42 might be an engine exhaust driven fan and/or supercharger in which instance source 42 would supply pressure air via a conduit 44 to the valve 40 and this pressure air will have an effect, which soon will be described, of influencing the oil pressure value at which engine shut-down will be permitted to occur. At this point if suffices to note that the pressure air is of an increasing value as the engine power speed increases, and that therefore it is a reliable and usable indication of the operating requirement of the engine.

In the use of the pressure source 42 just mentioned, or any other suitable pressure source, which will be understood to be any source manifesting a pressure force by pressure air that is exerted during the operation of the engine and one which is indicative or tell-tale of its power requirement at that time, said source has a conduit connection 44 to the valve 40. Thus, the pressure exerted by source 42 is effectively introduced to an inlet 46 communicating via passage 48 to the oil pressure chamber 50 of valve 40, but significantly on the remote or opposite side of the piston 52 operating therein. Thus a resisting pressure, designated 54 in FIG. 2 is exerted in opposition to the pressure force 56 of the oil entering the chamber 50 through the inlet 58. Thus, the minimum oil pressure 56 which is required at any point in time to maintain the fuel supply to the internal combustion engine has to be an amount necessary to overcome not only any spring bias pressure, as is the case in the prior art valve 10, but significantly also the additional opposing pressure 54 of the pressure source 42. Since, as already indicated, pressure source 42 supervises the engine during its operation and is indicative of the power requirement of the engine, it necessarily follows that the minimum oil pressure 56 that is required to prevent engine shut-down is related to the power requirement of the engine operation and thus to the lubrication requirements of the engines at that specific condition.

The improved shut-down functioning of the valve 40 over and above the prior art valve 10, as just described, necessitates a different construction in the valve as will now be described. Specifically, because of the pressure fluid behind the piston 52, and thus in opposition to the oil pressure 56, it is necessary to prevent this pressure fluid from mixing and contaminating the fuel which flows into the valve 40 through the inlet 60, through a cylindrical flow passage 62, and out of the valve 40 to the fuel pump and/or injectors through the outlet 64. This is achieved by the provision of a piston 66 having a sealing ring 68 which effectively isolates the fuel flow passage 62 from the remote side of the oil pressure chamber 50. In this connection, piston 52 also is provided with a sealing ring 70 which effectively sealingly isolates the oil in the left-hand side of the chamber 50 from the pressure fluid from source 42 which is in the right-hand side of this chamber, more particularly designated 72 in FIG. 2.

The pistons 52 and 66 are located in proper spaced relation along a cylindrical body 74 of the valve 40, this valve body also including a length portion 76 on the left-hand side of the piston 52 which has a function soon to be described, and also a length portion 78 on the right-hand side of the piston 66. The valve body length portion 78 further includes a fuel cut-off piston 80 having a sealing ring 82. Piston 80 is advantageously located along valve body 78 and is so sized relative to the fuel flow passage 62 that when the piston enters into this flow passage it is effective in cutting off the flow of fuel from inlet 60 to the outlet 64. This shut-off movement 84 of piston 80, i.e. movement of the piston from its full line to its phantom line position as illustrated in FIG. 2, occurs when there is a failure in the oil pressure 56 and when, therefore, there is movement in the piston 52 to the left until the length portion 76 seats against the valve closure wall 86. That is, when the pressure 54 exceeds the oil pressure 56, piston 52 is of course urged through movement to the left and will partake of this movement to the extent of the distance 88, which distance of course corresponds to the distance 84 and which, as already noted, allows the fuel cut-off piston 80 to enter into the passage 62 and thus cut off the flow of fuel from the supply to the fuel pump and/or injectors.

To assist in maintaining the concentricity of the valve body 74, 76, 78 relative to the flow passage 62, the right-hand end of the valve body is projected within a helical spring 90 which is seated against an opposite valve closure wall 92.

To assist in engine start up for certain engines, and certain conditions, particularly those for Mack, Cummins, Detroit and Caterpillar engines, valve 40, and more particularly the valve body length portion 78 thereof, is provided with an auxiliary internal fuel bypass passage 94 which has an outlet, as at 96, in communication with the fuel outlet 64. The flow of fuel through this auxiliary passage is factory orificed for all engines by threadably adjusting the closure member 98 provided at the inlet end of the passage 94.

From the foregoing description it should be readily appreciated that valve 40 provides engine shut-down based on supervision of the oil pressure, but not just in accordance with lubricaton requirements of the engine at start up, but also at various operating power requirements of the engine, which correspondingly have different lubrication requirements. Although a preferred embodiment of the valve 40 has been described herein, it will be understood that a latitude of modification, change and substitution is intended in the foregoing disclosure and that in some instances some features of the invention will be employed without a corresponding use of other features. Accordingly, it is appropriate that the appended claims be construed broadly and in a manner consistent with the spirit and scope of the invention herein.

What is claimed is:

1. An internal combustion engine shut-down control valve of the type having fuel for powering said engine flowing through an internal valve opening therein that is normally spring-biased closed except as a piston therein is biased by the oil pressure of said engine through movement towards said internal valve opening for maintaining the same in an open condition, the improvement to said shut-down control valve comprising means of exerting a pressure within said engine selected as a variable pressure source indicative of the operating requirement of said engine, and conduit means connected between said selected pressure exerting means and said movement path of said internal valve-opening piston so as to interpose the exerted pressure of the former in opposition to said valve-opening movement of the latter, whereby engine shut-down occasioned by the termination of fuel flowing through said internal valve opening is related to the exerted pressure of said selected pressure source and thus also to said engine operating speed.

2. An improved engine shut-down control valve as claimed in claim 1 wherein said internal valve opening is in the form of a cylindrical fuel flow passage, and cooperating therewith is a piston sized to serve as a closure when operatively located in said fuel flow passage, said closure-sized piston and said valve-opening piston of said valve being disposed in spaced apart relation on a body of said valve operatively arranged for sliding movement within said fuel flow passage.

3. An improved engine shut-down control valve as claimed in claim 2 including an auxiliary fuel flow passage formed internally of said valve body, and adjustable closure means in communication with an inlet end of said auxiliary fuel flow passage for regulating fuel flow therethrough in bypassed relation to said internal valve opening.

4. An improved engine shut-down control valve as claimed in claim 3 wherein said selected pressure exerting means of said engine is an engine exhaust driven fan thereof, and the pressure thereof is exerted by pressure air flowing therefrom through said conduit means to said valve-opening piston.

5. An improved engine shut-down control valve as claimed in claim 3 wherein said selected pressure exerting means of said engine is a supercharger thereof, and the pressure thereof is exerted by pressure air flowing therefrom through said conduit means to said valve-opening piston.

* * * * *